US009031432B2

(12) United States Patent
Shirodai et al.

(10) Patent No.: US 9,031,432 B2
(45) Date of Patent: May 12, 2015

(54) WET-TYPE IMAGE FORMING APPARATUS AND METHOD OF SETTING TRANSFER BIAS IN WET-TYPE IMAGE FORMING APPARATUS

(71) Applicants: Yasuo Shirodai, Nara (JP); Masahiko Matsuura, Suita (JP); Takeshi Maeyama, Ikeda (JP)

(72) Inventors: Yasuo Shirodai, Nara (JP); Masahiko Matsuura, Suita (JP); Takeshi Maeyama, Ikeda (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/644,586

(22) Filed: Oct. 4, 2012

(65) Prior Publication Data

US 2013/0084090 A1 Apr. 4, 2013

(30) Foreign Application Priority Data

Oct. 4, 2011 (JP) ..... 2011-220198

(51) Int. Cl.
*G03G 15/10* (2006.01)
*G03G 15/16* (2006.01)
*G03G 15/00* (2006.01)

(52) U.S. Cl.
CPC ..... *G03G 15/104* (2013.01); *G03G 15/1675* (2013.01); *G03G 15/5058* (2013.01); *G03G 15/5062* (2013.01)

(58) Field of Classification Search
CPC ..... G03G 15/105
USPC ..... 399/49, 57
See application file for complete search history.

(56) References Cited

U.S. PATENT DOCUMENTS 7,062,202 B2 * 6/2006 Kitazawa et al. ..... 399/237
8,369,729 B2 * 2/2013 Torimaru ..... 399/66

(Continued)

FOREIGN PATENT DOCUMENTS

JP 5-289544 A 11/1993
JP 8-328398 A 12/1996
JP 2003-131501 A 5/2003

(Continued)

OTHER PUBLICATIONS

Office Action (Notice of Grounds of Rejection) issued on Aug. 20, 2013, by the Japanese Patent Office in corresponding Japanese Patent Application No. 2011-220198, and an English Translation of the Office Action. (6 pages).

*Primary Examiner* — Clayton E LaBalle
*Assistant Examiner* — Leon W Rhodes, Jr.
(74) *Attorney, Agent, or Firm* — Buchanan Ingersoll & Rooney PC

(57) ABSTRACT

In a wet-type image forming apparatus, a plurality of patch images are successively transferred to a recording medium corresponding to a plurality of transfer biases obtained as bias value of the transfer bias is changed; density detecting unit measures image density of each of the plurality of patch images on the recording medium and detects a range of bias values of transfer bias in which the image density of patch image is substantially saturated; and the bias value of transfer bias when a normal image is formed on the recording medium is set to be within the range of bias values of transfer bias in which the image density of patch image is substantially saturated and to be not larger than absolute value of the bias value at which the image density of patch image is substantially saturated.

8 Claims, 8 Drawing Sheets

(56) References Cited

U.S. PATENT DOCUMENTS

| | | | | |
|---|---|---|---|---|
| 2008/0038006 | A1* | 2/2008 | Imagawa et al. | 399/49 |
| 2009/0142087 | A1 | 6/2009 | Iimura | |

FOREIGN PATENT DOCUMENTS

| | | | |
|---|---|---|---|
| JP | 2004-117847 | A | 4/2004 |
| JP | 2009-265604 | A | 11/2009 |

* cited by examiner

WET-TYPE IMAGE FORMING APPARATUS AND METHOD OF SETTING TRANSFER BIAS IN WET-TYPE IMAGE FORMING APPARATUS

This application is based on Japanese Patent Application No. 2011-220198 filed with the Japan Patent Office on Oct. 4, 2011, the entire content of which is hereby incorporated by reference.

BACKGROUND OF THE INVENTION

1. Field of the Invention

The present invention relates to a wet-type image forming apparatus provided in a copier, a printer, a facsimile or a multi-functional peripheral having these functions, as well as to a method of setting a transfer bias in such a wet-type image forming apparatus.

2. Description of the Related Art

Wet-type image forming apparatuses forming images using a liquid developer have been known, for example, from the disclosures of Japanese Laid-Open Patent Publication Nos. 08-328398 and 05-289544. The liquid developer used in such a wet-type image forming apparatus contains an insulating carrier liquid and granular toner (also referred to as toner particles) dispersed in the carrier liquid.

In the wet-type image forming apparatus, the liquid developer is drawn up from a developer tank and held on a surface of a developer carrier (developing roller). The toner in the liquid developer held on the developer carrier is transferred to an image carrier (photoreceptor), when a development bias is applied. An electrostatic latent image formed on the image carrier is visualized as a toner image, by the toner in the liquid developer.

The toner image on the image carrier is transferred to a transfer-receiving member such as a sheet of recording paper or an intermediate transfer body, when a transfer bias is applied. When the toner image is transferred to an intermediate transfer body, the toner image that has been transferred to the intermediate transfer body is transferred to a sheet of recording paper upon application of another transfer bias.

Toner particles used in the wet-type image forming apparatus using a liquid developer has particle diameter smaller than that used in a dry-type image forming apparatus. Because of the toner particles of smaller diameter, fine details of the image can be expressed on a sheet of recording paper. Thus, by the wet-type image forming apparatus using a liquid developer, images of high quality can be formed on a sheet of recording paper.

SUMMARY OF THE INVENTION

On a sheet of recording paper having an image formed by a wet-type image forming apparatus, sometimes a phenomenon referred to as "granular irregularity" occurs, in which portions having densely concentrated toner particles and portions having sparse toner particles appear periodically. If granular irregularity appears on a sheet of recording paper, by way of example, a portion which should be filled solidly may have a portion not covered by the toner. Further, if granular irregularity appears on a sheet of recording paper, image density becomes lower than when such granular irregularity does not occur on the sheet of recording paper.

The present invention provides a wet-type image forming apparatus forming an image on a transfer-receiving member, including: an image carrier carrying an electrostatic latent image on its surface; a developer carrier carrying on its surface a liquid developer having toner dispersed in a carrier liquid; an image forming unit configured to visualize the electrostatic latent image by the toner in the liquid developer carried on the developer carrier and to form a toner image on the image carrier; a transfer unit configured to transfer the toner image formed on the image carrier to the transfer-receiving member by applying a transfer bias; and a density detecting unit configured to detect image density of the toner image as a patch image transferred to the transfer-receiving member; wherein a plurality of the aforementioned patch images are formed on the image carrier; the plurality of patch images are successively transferred to the transfer-receiving member, each corresponding to each of the transfer biases obtained as bias value of the transfer bias is changed; the density detecting unit measures the image density of each of the plurality of patch images successively transferred to the transfer-receiving member, and detects a range of bias values of the transfer bias in which the image density of the patch image is substantially saturated; and the bias value of the transfer bias when the image is formed on the transfer-receiving member is set to be within the range of bias values of the transfer bias in which the image density of the patch image is substantially saturated and to be not larger than absolute value of the bias value at which the image density of the patch image is substantially saturated.

The present invention provides a method of setting a transfer bias in a wet-type image forming apparatus forming an image on a transfer-receiving member, wherein the wet-type image forming apparatus includes an image carrier carrying an electrostatic latent image on its surface, a developer carrier carrying on its surface a liquid developer having toner dispersed in a carrier liquid, an image forming unit configured to visualize the electrostatic latent image by the toner in the liquid developer carried on the developer carrier and to form a toner image on the image carrier, a transfer unit configured to transfer the toner image fattened on the image carrier to the transfer-receiving member by applying a transfer bias, and a density detecting unit configured to detect image density of the toner image as a patch image transferred to the transfer-receiving member; the method including the steps of: forming a plurality of patch images on the image carrier; successively transferring the plurality of patch images to the transfer-receiving member, each corresponding to each of the transfer biases obtained as bias value of the transfer bias is changed; the density detecting unit measuring the image density of each of the plurality of patch images successively transferred to the transfer-receiving member; determining a range of bias values of the transfer bias in which the image density of the patch image is substantially saturated; and setting the bias value of the transfer bias when the image is formed on the transfer-receiving member to be within the range of bias values of the transfer bias in which the image density of the patch image is substantially saturated and to be not larger than absolute value of the bias value at which the image density of the patch image is substantially saturated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
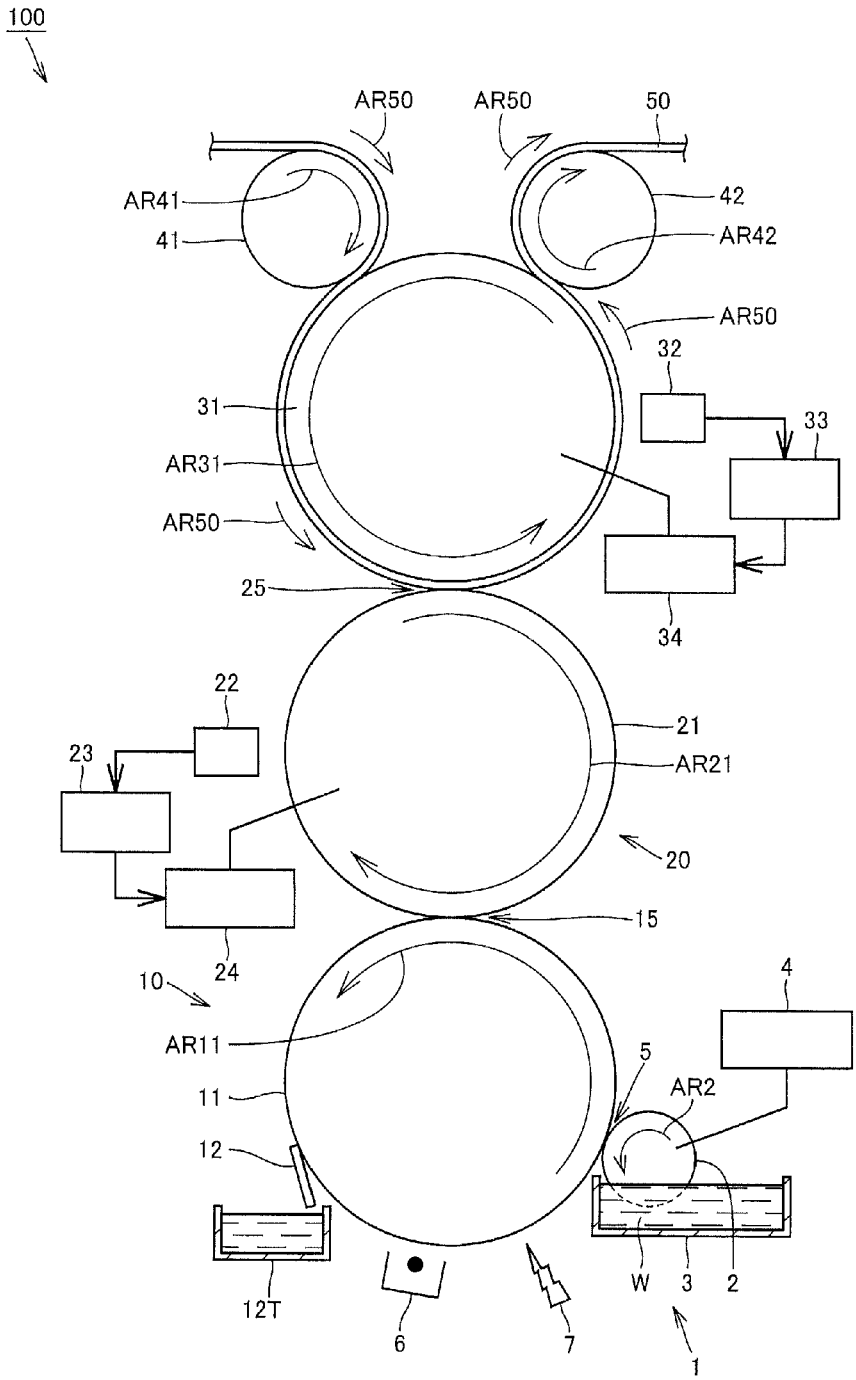
FIG. 1 is a schematic diagram showing a wet-type image forming apparatus in accordance with Embodiment 1.

Embodiments of the present invention will be described in the following with reference to the figures. In the embodiments described in the following, descriptions of numbers, amounts and the like are not intended to limit the scope of the invention unless otherwise specified. In the description of embodiments, the same or corresponding portions will be denoted by the same reference characters, and accumulative description may not be repeated.

Embodiment 1

Wet-type Image Forming Apparatus 100

Figure 2:
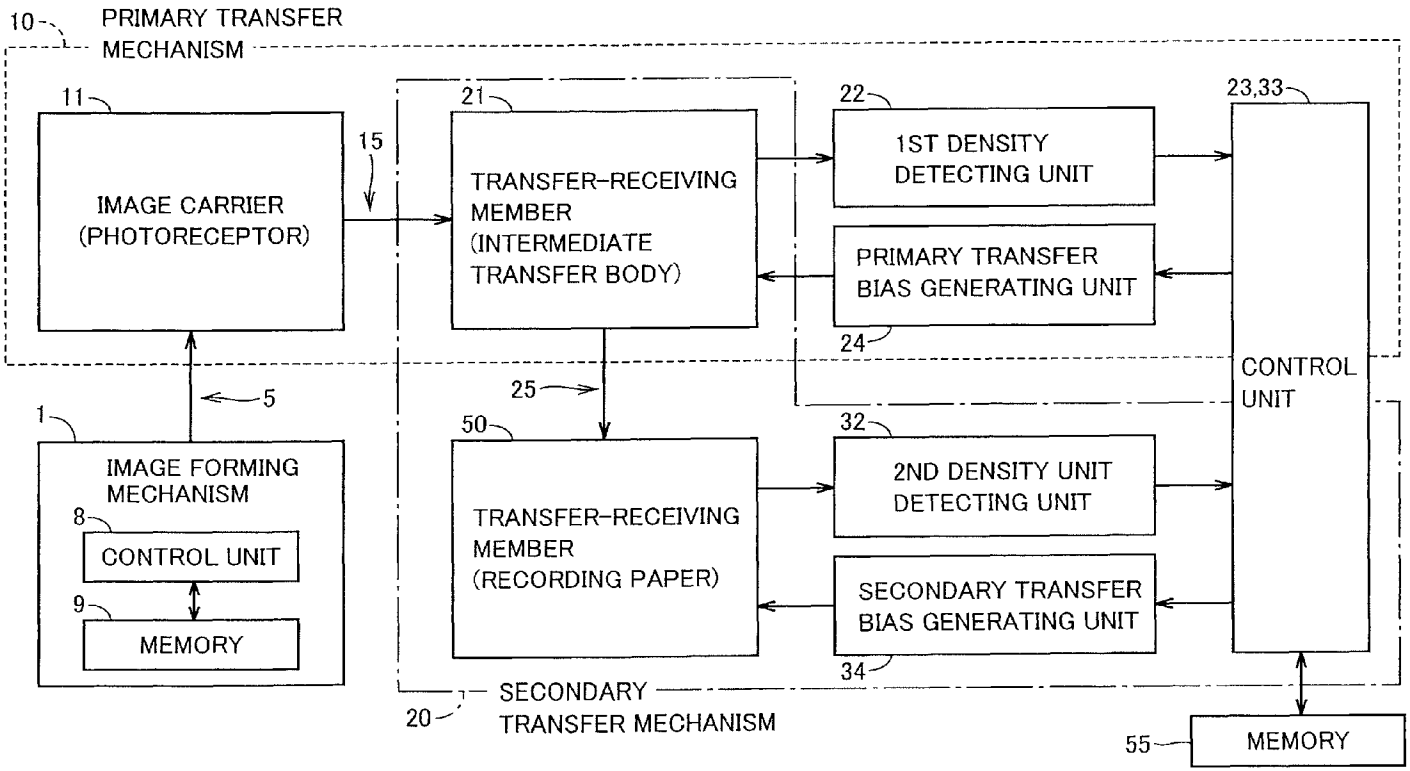
FIG. 2 is a block diagram showing various components realizing the control flow related to formation of patch images in the wet-type image forming apparatus in accordance with Embodiment 1.
Figure 3:
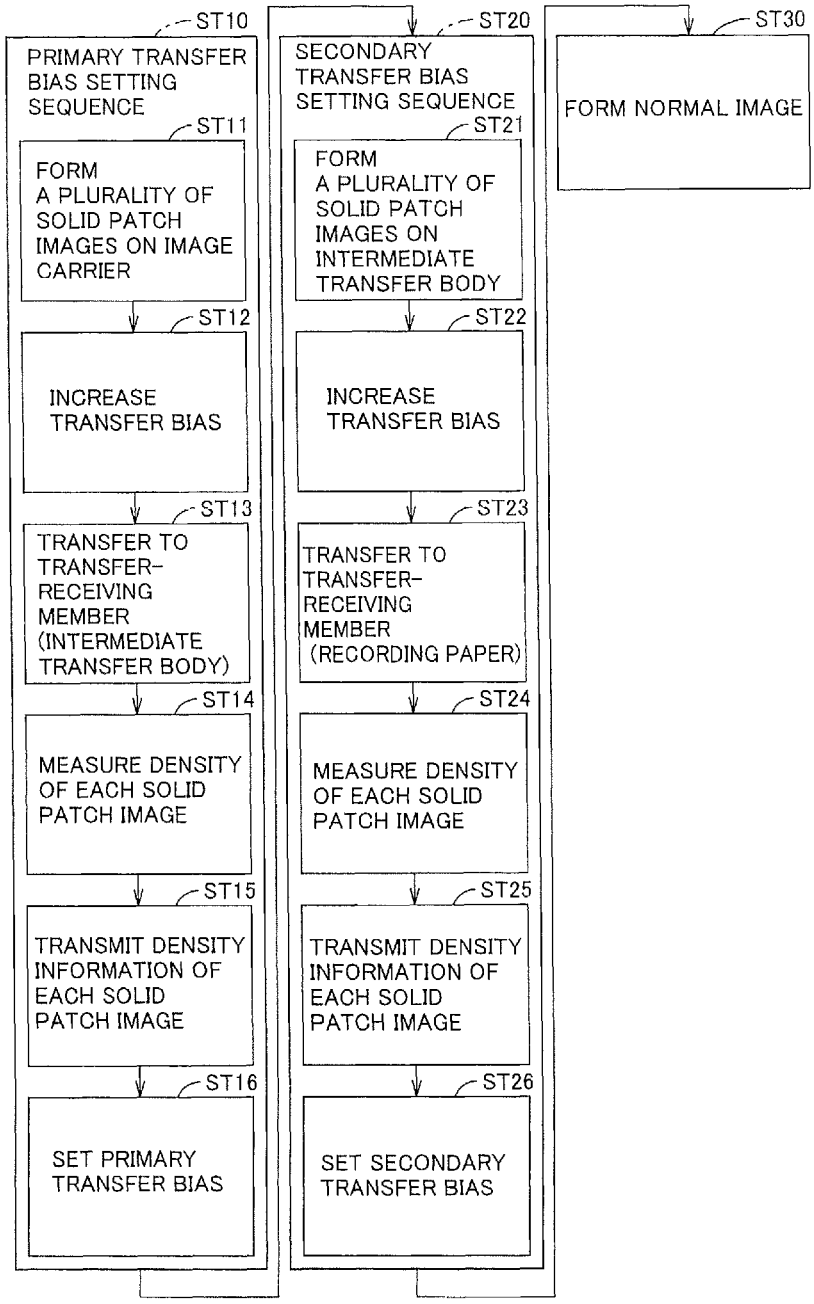
FIG. 3 shows a control flow related to formation of patch images and formation of a normal image of the wet-type image forming apparatus in accordance with Embodiment 1.

Referring to FIGS. 1 to 3, a wet-type image forming apparatus 100 in accordance with the present embodiment will be described. FIG. 1 is a schematic diagram showing an overall configuration of wet-type image forming apparatus 100. FIG. 2 is a block diagram showing various components realizing the control flow related to formation of patch images of wet-type image forming apparatus 100. FIG. 3 shows a control flow related to formation of patch images and formation of a normal image of wet-type image forming apparatus 100.

As shown in FIG. 1, wet-type image forming apparatus 100 forms a prescribed image on a sheet of recording paper 50. The sheet of recording paper 50 is fed by conveyer rollers 41 and 42 as well as a transfer roller 31, along a feeding direction AR50. The prescribed image formed on the sheet of recording paper 50 includes a normal image formed based on an external signal input by a user of wet-type image forming apparatus 100 and solid patch images formed as a trial by wet-type image forming apparatus 100 for preventing occurrence of granular irregularity during formation of the normal image.

Wet-type image forming apparatus 100 in accordance with the present invention includes an image forming mechanism 1, a primary transfer mechanism 10 and a secondary transfer mechanism 20. In the following, configurations of each of image forming mechanism 1 and primary and secondary transfer mechanisms 10 and 20 will be described, together with an operation when a normal image is formed by wet-type image forming apparatus 100. The operation of image forming mechanism 1 and primary and secondary transfer mechanisms 10 and 20 when the solid patch images are formed will be described later.

(Image Forming Mechanism 1)

Image forming mechanism 1 includes a developing roller 2 (developer carrier), a liquid developer W, a developer tank 3, a developing bias generator 4 (image forming unit), a charger 6 and an exposing device 7. Image forming mechanism visualizes an electrostatic latent image formed on a surface of a photoreceptor 11 using liquid developer W at a developing portion 5, as will be described in detail later. By the visualization, a toner image (not shown) is formed on the surface of photoreceptor 11.

Liquid developer W is kept in developer tank 3. Liquid developer W contains toner particles and a carrier liquid. The toner particles are dispersed in the carrier liquid at a prescribed ratio. Developing roller 2 rotates in a direction of an arrow AR2, partially dipped in liquid developer W. Liquid developer W is drawn up to the surface of developing roller 2 as developing roller 2 rotates. Liquid developer W is carried on the surface of developing roller 2 and fed to developing portion 5 as developing roller 2 rotates.

Liquid developer W carried on developing roller 2 is adjusted such that liquid developer W has uniform thickness. The toner particles in liquid developer W with its thickness adjusted are, for example, charged "positive" by a developer charger (not shown). Developing bias generator 4 forms an electric field between developing roller 2 and photoreceptor 11, which will be described later, by applying a developing bias. Liquid developer W carried on developing roller 2 is transferred to the surface of photoreceptor 11 by the function of this electric field.

(Liquid Developer W)

Liquid developer W in accordance with the present embodiment will be described in detail. Liquid developer W contains an insulating carrier liquid, the toner for developing electrostatic latent images, and a dispersing agent for dispersing the toner, as main components. Average particle diameter of toner contained in liquid developer W is, for example, 0.1 μm to 5 μm. If the average particle diameter of toner contained in liquid developer W is smaller than 0.1 μm, development quality degrades. If the average particle diameter of toner contained in liquid developer W is larger than 5 μm, image quality degrades.

As the carrier liquid, volatile liquid is preferred, so that the liquid is not left on the sheet of recording paper 50. Examples of volatile liquid may include silicone oil, mineral oil, and paraffin oil. As toner binding resin, thermoplastic resin such as polystyrene resin, styrene-acryl resin, acrylic resin, polyester resin, epoxy resin, polyamide resin, polyimide resin or polyurethane resin may be preferably used. Two or more of these resins may be used, or mixture of these resins may be used, as the toner binding resin.

Commercially available common pigments and dyes may be used for coloring toner. Examples of pigment used for coloring toner may include carbon black, colcothar, titanium oxide, silica, phthalocyanine blue, phthalocyanine green, sky blue, benzidine yellow and lake red D. Examples of dye may include solvent red 27 and acid blue 9.

Regarding the method of preparing the liquid developer W, by way of example, binder resin and pigment of prescribed blend ratio are melted and kneaded to be uniformly dispersed using a pressure kneader, roller mill or the like, and the resulting dispersed body is pulverized, for example, by a jet mill. The fine powder thus obtained is classified using, for example, an air classifier, whereby colored toner having desired particle size can be obtained. Thus obtained toner particles are mixed with the carrier liquid, with a prescribed blend ratio. The mixture is uniformly dispersed using dispersing means such as a ball mill, and thus, the liquid developer W is obtained. Preferable toner density of liquid developer W is 10 mass % to 50 mass %.

(Primary Transfer Mechanism 10)

Primary transfer mechanism 10 includes photoreceptor 11 (image carrier), a cleaning blade 12, a recovery tank 12T and a primary transfer bias generating unit 24. By way of example, a photoreceptor formed of positively chargeable amorphous silicon may be used as photoreceptor 11.

Photoreceptor 11 is arranged opposite to developing roller 2 of image forming mechanism 1, and opposite to intermediate transfer body 21 of a secondary transfer mechanism 20, which will be described later. Between photoreceptor 11 and developing roller 2, a developing portion 5 is formed. Between photoreceptor 11 and intermediate transfer body 21, a transfer portion 15 (primary transfer portion) is formed.

Photoreceptor 11 rotates in a direction of an arrow AR11. Developing roller 2 (developing portion 5), intermediate transfer body 21 (transfer portion 15), cleaning blade 12, charger 6 and exposing device 7 are arranged around photoreceptor 11 in order, along the direction of rotation of photoreceptor 11.

Photoreceptor 11 has its surface uniformly charged to a prescribed potential by charger 6 of image forming mechanism 1. Photoreceptor 11 having its surface uniformly charged is exposed by exposing device 7 of image forming mechanism 1. An electrostatic latent image (not shown) based on prescribed image information is formed on the surface of photoreceptor 11. Photoreceptor 11 carries the electrostatic latent image thereon and conveys the electrostatic latent image to developing portion 5.

As will be described in detail later, exposing device 7 of image forming mechanism 1 in accordance with the present embodiment has the amount, scope and timing of exposure controlled based on common image information and additionally controlled by a control unit 8 (see FIG. 2). Control unit 8 is connected to a memory 9. Memory 9 stores information necessary for forming solid patch images, such as the amount, scope, and timing of exposure. As the exposing device 7 is controlled by control unit 8, electrostatic latent images corresponding to the solid patch images (details of which will be described later) are formed on the surface of photoreceptor 11.

When the latent electrostatic image is conveyed to developing portion 5, toner particles in liquid developer W carried on developing roller 2 are moved by static electricity from the surface of developing roller 2 to the surface of photoreceptor 11 by the function of electric field generated by developing bias generator 4. At this time, not only toner particles but also carrier liquid adheres on the surface of photoreceptor 11. The latent electrostatic image that has been formed on the surface of photoreceptor 11 is visualized as a toner image (or patch images, as will be described later).

Photoreceptor 11 carries the toner image formed on its surface and conveys the toner image to transfer portion 15. Liquid developer W not transferred from developing roller 2 to photoreceptor 11 but remaining on developing roller 2 is scraped away from the surface of developing roller 2 by the cleaning blade (not shown) and then recovered.

As described above, intermediate transfer body 21 is arranged opposite to photoreceptor 11. Intermediate transfer body 21 rotates in a direction of an arrow A21. Between photoreceptor 11 and intermediate transfer body 21, transfer portion 15 (primary transfer portion) is formed. Primary transfer bias generating unit 24 forms an electric field between photoreceptor 11 and intermediate transfer body 21 by applying a primary transfer bias. A first density detecting unit 22 and a control unit 23 shown in FIG. 1 are used when the solid patch images are formed. Details of the first density detecting unit 22 and control unit 23 will be described later.

The toner image carried on photoreceptor 11 and conveyed to transfer portion 15 is transferred (primary transfer) from the surface of photoreceptor 11 to the surface of intermediate transfer body 21 by the function of electric field formed by primary transfer bias generating unit 24. The toner not subjected to primary transfer but left on the surface of photoreceptor 11 as well as dirt and dust on the surface of photoreceptor 11 are scraped away from the surface of photoreceptor 11 by cleaning blade 12, and recovered in recovery tank 12T. Charges left on the surface of photoreceptor 11 are erased by an eraser lamp (not shown) or the like.

(Secondary Transfer Mechanism 20)

Secondary transfer mechanism 20 includes intermediate transfer body 21, a transfer roller 31 and a secondary transfer bias generating unit 34. Intermediate transfer body 21 is arranged opposite to transfer roller 31 (also referred to as a back-up roller) rotating in a direction of an arrow AR31. Between intermediate transfer body 21 and transfer roller 31, a transfer portion 25 (secondary transfer portion) is formed.

Transfer roller 31 is arranged opposite to a conveyer roller 41 rotating in a direction of an arrow AR41 and a conveyer roller 42 rotating in a direction of an arrow AR42, respectively. A sheet of recording paper 50 wound around transfer roller 31 is moved passing through transfer portion 25, by means of conveyer rollers 41 and 42.

After the toner image is transferred by the primary transfer from the surface of photoreceptor 11 to the surface of intermediate transfer body 21 at transfer portion 15, intermediate transfer body 21 carries the toner image (or the solid patch images as will be described later) that has been transferred to its surface, and further conveys the toner image to transfer portion 25. Secondary transfer bias generating unit 34 forms an electric field between intermediate transfer body 21 and the sheet of recording paper 50 by applying a secondary transfer bias. A second density detecting unit 32 and a control unit 33 shown in FIG. 1 are used when the patch images are formed. Details of second density detecting unit 32 and control unit 33 will be described later.

The toner image carried on intermediate transfer body 21 and conveyed to transfer portion 25 is transferred (secondary transfer) from the surface of intermediate transfer body 21 to the surface of the sheet of recording paper 50 by the function of electric field formed by secondary transfer bias generating unit 34. The toner not transferred by the secondary transfer but left on the surface of intermediate transfer body 21 and dirt and dust on intermediate transfer body 21 are scraped away from the surface of intermediate transfer body 21 by a cleaning blade (not shown), and recovered in a recovery tank (not shown).

After secondary transfer, the sheet of recording paper 50 is fed to a fixing device (not shown). The toner particles in the toner image transferred to the sheet of recording paper 50 are heated and pressed by the fixing device. The toner image transferred to the sheet of recording paper is fixed on the surface of the sheet of recording paper 50 by this pressing and heating. Thereafter, the sheet of recording paper 50 is discharged to the outside through a paper discharge mechanism (not shown). In this manner, a normal image forming operation of wet-type image forming apparatus 100 is completed.

(Transfer Bias Setting Sequence)

In wet-type image forming apparatus 100, when a normal image is formed on the sheet of recording paper 50, in order to prevent generation of granular irregularity or lower image density resulting therefrom, the primary transfer bias applied by the primary transfer bias generating unit 24 and the secondary transfer bias applied by secondary transfer bias generating unit 34 are set to prescribed values, respectively, before forming a normal image.

As shown in FIG. 3, in wet-type image forming apparatus 100, a primary transfer bias setting sequence ST10 and a secondary transfer bias setting sequence ST20 are successively executed, before forming the normal image (ST30). In the following, the sequences ST10 and ST20 will be described.

(Primary Transfer Bias Setting Sequence ST10)

The primary transfer bias setting sequence ST10 is executed, for example, immediately after power-on of wet-type image forming apparatus 100, after a prescribed number of images are formed by wet-type image forming apparatus 100, and/or after a prescribed time passed from the last formation of an image by wet-type image forming apparatus 100.

The timing when primary transfer bias setting sequence ST10 is executed is stored, for example, in a memory 9 of image forming mechanism 1. Control unit 8 determines whether or not prescribed conditions are satisfied. Control unit 8 sends a signal to execute primary transfer bias setting sequence ST10 to a main control unit (not shown) of wet-type image forming apparatus 100.

Referring to FIGS. 1 to 3, when primary transfer bias setting sequence ST10 is executed, first, control unit 8 connected to exposing device 7 reads information related to the amount, scope and timing of exposure necessary for forming a plurality of patch images on photoreceptor 11, from memory 9. Exposing device 7 controlled by control unit 8 successively forms a plurality of electrostatic latent images corresponding to the plurality of solid patch images on photoreceptor 11.

The plurality of electrostatic latent images are conveyed to developing portion 5. By a developing bias (fixed value) applied by developing bias generating unit 4, the plurality of electrostatic images are visualized at developing portion 5. On the surface of photoreceptor 11, a plurality of solid patch images are formed at a portion upstream of transfer portion 15 (see sequence ST11 of FIG. 3).

The plurality of solid patch images move to transfer portion 15 as photoreceptor 11 rotates. When the solid patch images enter transfer portion 15, a primary transfer bias is applied by primary transfer bias generating unit 24 between photoreceptor 11 and transfer portion 15.

The bias value of primary transfer bias applied by primary transfer bias generating unit 24 is set lower by a prescribed value than the bias value used for general image formation, before the solid patch images enter the transfer portion 15. The bias value of primary transfer bias applied by primary transfer bias generating unit 24 is increased gradually by control unit 23 every time a solid patch image enters the transfer portion 15 (see sequence ST12 of FIG. 3).

The plurality of solid patch images are successively transferred, one by one in electrostatic manner, from photoreceptor 11 to intermediate transfer body 21 at transfer portion 15, corresponding to each of a plurality of transfer biases attained by the change in bias value of the primary transfer bias (see sequence ST13 of FIG. 3).

Figure 4:
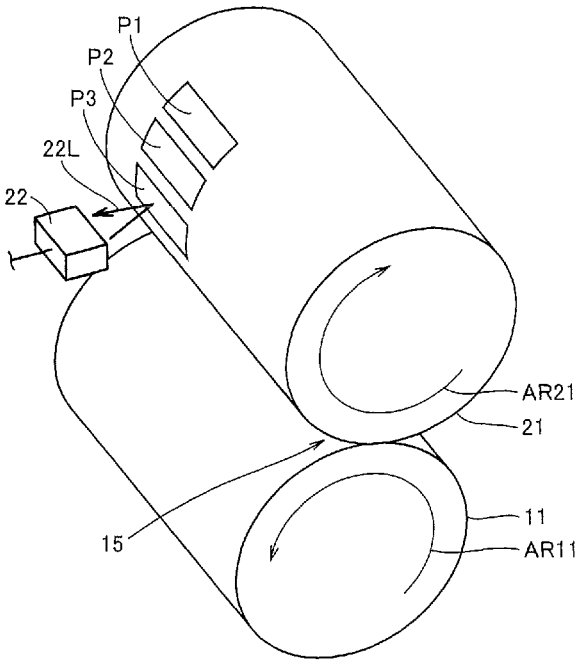
FIG. 4 is a perspective view showing the manner how patch images are transferred from a photoreceptor to an intermediate transfer body used in the wet-type image forming apparatus in accordance with Embodiment 1.

As shown in FIG. 4, at a portion of the surface of intermediate transfer body 21 downstream of transfer portion 15, a first density detecting unit 22 is arranged. The first density detecting unit 22 detects the density of each of solid patch images P1, P2 and P3 that have been transferred to the surface of intermediate transfer body 21, based on reflected light of laser beam 22L (by optical means) (see sequence ST14 of FIG. 3).

The image density information of each of the plurality of solid patch images (solid patch images P1, P2 and P3) detected by first density detecting unit 22 is transmitted to control unit 23 (see sequence ST15 of FIG. 3).

Figure 5:
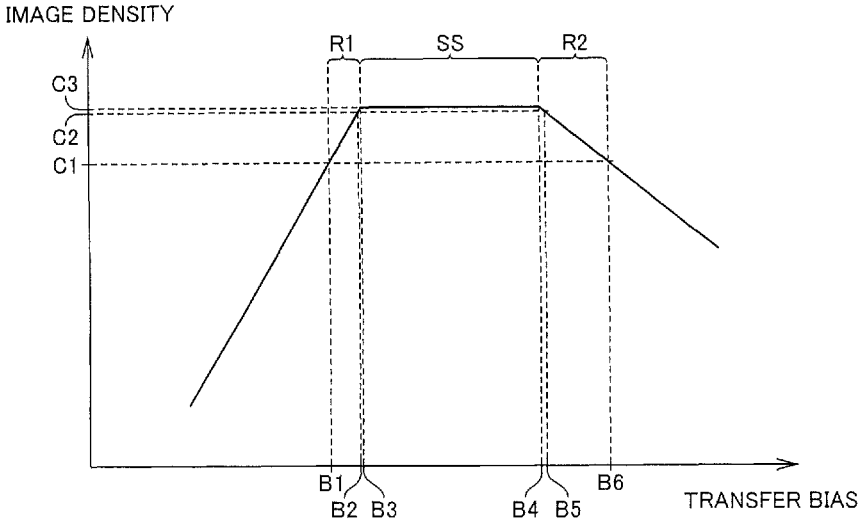
FIG. 5 shows a relation between the magnitude of transfer bias applied to a transfer portion and image density of a transferred patch image.

Referring to FIG. 5, as the bias value of primary transfer bias increases gradually, the image density of solid patch images transferred to intermediate transfer body 21 also increases. If the primary transfer bias is set to a bias value B1, a solid patch image having image density C1 (C1=C3×90%) is obtained. If the primary transfer bias is set to a bias value B2 (B2>B1), another solid patch image having the image density C2 (C2=C3×99%>C1) is obtained.

If the primary transfer bias is set to a bias value B3 (B3>B2), a solid patch image having image density C3 is obtained. When the primary transfer bias is increased from bias value B3 to a bias value B4 (B4>B3), again, a solid patch image having the constant image density C3 is obtained. Specifically, the image density of solid patch image does not increase but saturated if the primary transfer bias is in the range SS between bias values B3 and B4.

If the primary transfer bias is set to a bias value B5 (B5>B4), a solid patch image having image density C2 is obtained. The image density of solid patch image becomes lower than the image density of solid patch image transferred to intermediate transfer body 21 before the present solid patch image. Similarly, if the primary transfer bias is set to a bias value B6 (B6>B5), a solid patch image having image density C1 is obtained. The image density of solid patch image becomes lower than the image density of solid patch image transferred to intermediate transfer body 21 before the present solid patch image. The reason why the image density of solid patch image decreases is that discharge starts at transfer portion 15 because of excessive increase of bias value of the primary transfer bias.

As described above, bias values B1 to B6 of primary transfer bias and the corresponding pieces of information of image densities C1 to C3 of respective solid patch images are transmitted to control unit 23 connected to the first density detecting unit 22. Based on the pieces of information received from the first density detecting unit 22, control unit 23 calculates the ranges R1 and R2 of bias values of the primary transfer bias when the image density of solid patch images is substantially saturated.

Here, "the image density of patch images is substantially saturated" means that the image density of patch image transferred to intermediate transfer body 21 hardly changes even if the bias value of primary transfer bias increases. The situation where the image density of patch image is substantially saturated includes when the toner image or toner images conveyed to transfer portion 15 by the rotation of photoreceptor 11 are fully (100%) transferred to intermediate transfer body 21. The situation where the image density of patch image is substantially saturated also includes when the toner images of a prescribed ratio (90% to 99%, depending on the accuracy of density detection) are transferred to intermediate transfer body 21 with the image density hardly varying. The prescribed ratio is stored in advance in a memory 55 (see FIG. 2) connected to control unit 23.

By comparing the image density of each of the plurality of solid patch images received from the first density detecting unit 22 with the prescribed ratio stored in memory 55, control unit 23 calculates the range R1 (the range in which the image density (transfer efficiency) is 90% to 100%, that is, the range where "B1≤bias value of primary transfer bias≤B3") of bias values of primary transfer bias when the image density of solid patch images is substantially saturated. Further, control unit 23 calculates another range R2 (the range in which the image density (transfer efficiency) is 90% to 100%, that is, the range where "B4≤bias value of primary transfer bias≤B6") of bias values of primary transfer bias when the image density of solid patch images is substantially saturated.

Thereafter, control unit 23 sets the bias value of primary transfer bias used for forming a normal image to a value within the ranges R1 and R2 and not larger than the absolute value of bias value at which the image density of patch image is saturated (that is, within the range R1) (see sequence ST16 of FIG. 3).

In primary transfer bias setting sequence ST10, the bias value of primary transfer bias used for forming a normal image is set at a prescribed value in the range R1, as a fixed value, through each of the sequences ST11 to ST16.

(Secondary Bias Setting Sequence ST20)

Secondary bias setting sequence ST20 is executed after the bias value of primary transfer bias used for forming a normal image is set by the primary transfer bias setting sequence ST10.

Referring to FIGS. 1 to 3, secondary transfer bias setting sequence ST20 is executed with the bias value of primary transfer bias set at the prescribed value. In secondary transfer bias setting sequence ST20, control unit 8 connected to exposing device 7 reads information related to the amount, scope and timing of exposure necessary for forming a plurality of patch images on photoreceptor 11, from memory 9. Exposing device 7 controlled by control unit 8 successively forms a plurality of electrostatic latent images corresponding to the plurality of solid patch images on photoreceptor 11.

The plurality of electrostatic latent images are conveyed to developing portion 5. By a developing bias (fixed value) applied by developing bias generating unit 4, the plurality of electrostatic images are visualized at developing portion 5. On the surface of photoreceptor 11, a plurality of solid patch images are formed at a portion upstream of transfer portion 15.

The plurality of solid patch images move to transfer portion 15 as photoreceptor 11 rotates. When the solid patch images enter transfer portion 15, a primary transfer bias (fixed value) is applied by primary transfer bias generating unit 24 between photoreceptor 11 and transfer portion 15. Each of the plurality of solid patch images is successively transferred in electrostatic manner from photoreceptor 11 to intermediate transfer body 21 at transfer portion 15. On intermediate transfer body 21, a plurality of solid patch images are formed (see sequence ST21 of FIG. 3).

The plurality of solid patch images transferred to intermediate transfer body 21 move to transfer portion 25 as intermediate transfer body 21 rotates. When solid patch images enter transfer portion 25, a secondary transfer bias is applied by secondary transfer bias generating unit 34 between intermediate transfer body 21 and the surface of the sheet of recording paper 50.

The bias value of secondary transfer bias applied by secondary transfer bias generating unit 34 is set lower by a prescribed value than the bias value used for general image formation, before the solid patch images enter the transfer portion 25. The bias value of secondary transfer bias applied by secondary transfer bias generating unit 34 is increased gradually by control unit 33 every time a solid patch image enters the transfer portion 25 (see sequence ST22 of FIG. 3).

The plurality of solid patch images are successively transferred, one by one in electrostatic manner, from intermediate transfer body 21 to the surface of the sheet of recording paper 50 at transfer portion 25, corresponding to each of a plurality of transfer biases attained by the change in bias value of the secondary transfer bias (see sequence ST23 of FIG. 3).

Referring to FIGS. 1 and 3, at a portion of recording surface of the sheet of recording paper 50 downstream of transfer portion 25, a second density detecting unit 32 is arranged. The second density detecting unit 32 detects density of each of the plurality of solid patch images transferred to the recording surface of the sheet of recording paper 50 based on reflected light of a laser beam (optical means) (see sequence ST24 of FIG. 3).

The image density information of each of the plurality of solid patch images detected by second density detecting unit 32 is transmitted to control unit 33 (see sequence ST25 of FIG. 3).

As in sequence ST15 of primary transfer bias setting sequence ST10, as the bias value of secondary transfer bias increases gradually, the image density of solid patch images transferred to the recording surface of the sheet of recording paper 50 also increases. Control unit 33 calculates the ranges R1 and R2 (see FIG. 5) of bias values of secondary transfer bias when the image density of solid patch images is saturated, based on the information received from second density detecting unit 32.

Here, "the image density of patch images is substantially saturated" means that the image density of patch image transferred to the recording surface of the sheet of recording paper 50 hardly changes even if the bias value of secondary transfer bias increases. The situation where the image density of patch image is substantially saturated includes when the toner image or toner images conveyed to transfer portion 25 by the rotation of intermediate transfer body 21 are fully (100%) transferred to the recording surface of the sheet of recording paper 50. The situation where the image density of patch image is substantially saturated also includes when the toner images of a prescribed ratio (90% to 99%, depending on the accuracy of density detection) are transferred to the recording surface of the sheet of recording paper 50 with the image density hardly varying. The prescribed ratio is stored in advance in a memory 55 (see FIG. 2) connected to control unit 33.

By comparing the image density of each of the plurality of solid patch images received from the second density detecting unit 32 with the prescribed ratio stored in memory 55, control unit 33 calculates the range R1 (the range in which the image density (transfer efficiency) is 90% to 100%, that is, the range where "B1 bias value of secondary transfer bias B3") of bias values of secondary transfer bias when the image density of solid patch images is substantially saturated. Further, control unit 33 calculates another range R2 (the range in which the image density (transfer efficiency) is 90% to 100%, that is, the range where "B4≤bias value of secondary transfer bias≤B6") of bias values of secondary transfer bias when the image density of solid patch images is substantially saturated.

Thereafter, control unit 33 sets the bias value of secondary transfer bias used for forming a normal image to a value within the ranges R1 and R2 and not larger than the absolute value of bias value at which the image density of patch image is saturated (that is, within the range R1) (see sequence ST26 of FIG. 3).

In secondary transfer bias setting sequence ST20, the bias value of secondary transfer bias used for forming a normal image is set at a prescribed value in the range R1, as a fixed value, through each of the sequences ST21 to ST26. For convenience of description, the range R1 of FIG. 5 is referred to for the description of both the primary and secondary transfer bias setting sequences ST10 and ST20. The range R1 detected by the primary transfer bias setting sequence ST10 is not always the same as the range R1 detected by the secondary transfer bias setting sequence ST20.

In wet-type image forming apparatus 100, the primary transfer bias setting sequence ST10 and the secondary transfer bias setting sequence ST20 are successively executed and, thereafter, a normal image is formed (ST30), as described above.

(Functions/Effects)

The phenomenon referred to as "granular irregularity" in which portions having densely concentrated toner particles and portions having sparse toner particles appear periodically occurs when the transfer efficiency of toner image reaches substantially 100% and thereafter a higher transfer bias is applied.

The reason for this is as follows. When a high transfer bias is applied to the transfer portion, a strong electric field is formed also in a space positioned upstream of the transfer portion (nip portion), and the toner particles in the toner image before transfer undesirably move. In contrast, in wet-type image forming apparatus 100 in accordance with the present embodiment, the bias value smaller in absolute value than the value immediately before occurrence of granular irregularity is set as the primary and secondary transfer biases.

In wet-type image forming apparatus 100, occurrence of granular irregularity can be prevented and, in addition, high efficiency of transferring toner image can be attained at the time of forming a normal image. Therefore, by wet-type image forming apparatus 100, it is possible to form images of higher quality on a sheet of recording paper.

In the present embodiment, primary bias generating unit 24 and first density detecting unit 22 are provided corresponding to transfer portion 15 (primary transfer portion), and secondary transfer bias generating unit 34 and second density detecting unit 32 are provided corresponding to transfer portion 25 (secondary transfer portion). Therefore, in the present embodiment, both the primary and secondary transfer bias generating units 24 and 34 correspond to the "transfer unit" and both the first and second density detecting unit correspond to the "density detecting unit."

If primary transfer bias generating unit 24 is considered to correspond to the "transfer unit" and first density detecting unit 22 to correspond to the "density detecting unit," then, intermediate transfer body 21 corresponds to the "transfer-receiving member." If secondary transfer bias generating unit 34 is considered to correspond to the "transfer unit" and second density detecting unit 32 to correspond to the "density detecting unit," then, the sheet of recording paper 50 corresponds to the "transfer-receiving member."

Wet-type image forming apparatus 100 may have the first density detecting unit 22 only, and the second density detecting unit 32 is not always necessary. In that case, primary transfer bias generating unit 24 corresponds to the "transfer unit," first density detecting unit 22 corresponds to the "density detecting unit," and intermediate transfer body 21 corresponds to the "transfer-receiving member." Even in this case, by wet-type image forming apparatus 100, occurrence of granular irregularity can be prevented and, in addition, high efficiency of transferring toner image can be attained at the time of forming a normal image.

Wet-type image forming apparatus 100 may have the second density detecting unit 32 only, and the first density detecting unit 22 is not always necessary. In that case, secondary transfer bias generating unit 34 corresponds to the "transfer unit," second density detecting unit 32 corresponds to the "density detecting unit," and the sheet of recording paper 50 corresponds to the "transfer-receiving member." Even in this case, by wet-type image forming apparatus 100, occurrence of granular irregularity can be prevented and, in addition, high efficiency of transferring toner image can be attained at the time of forming a normal image.

Modification of Embodiment 1

Figure 6:
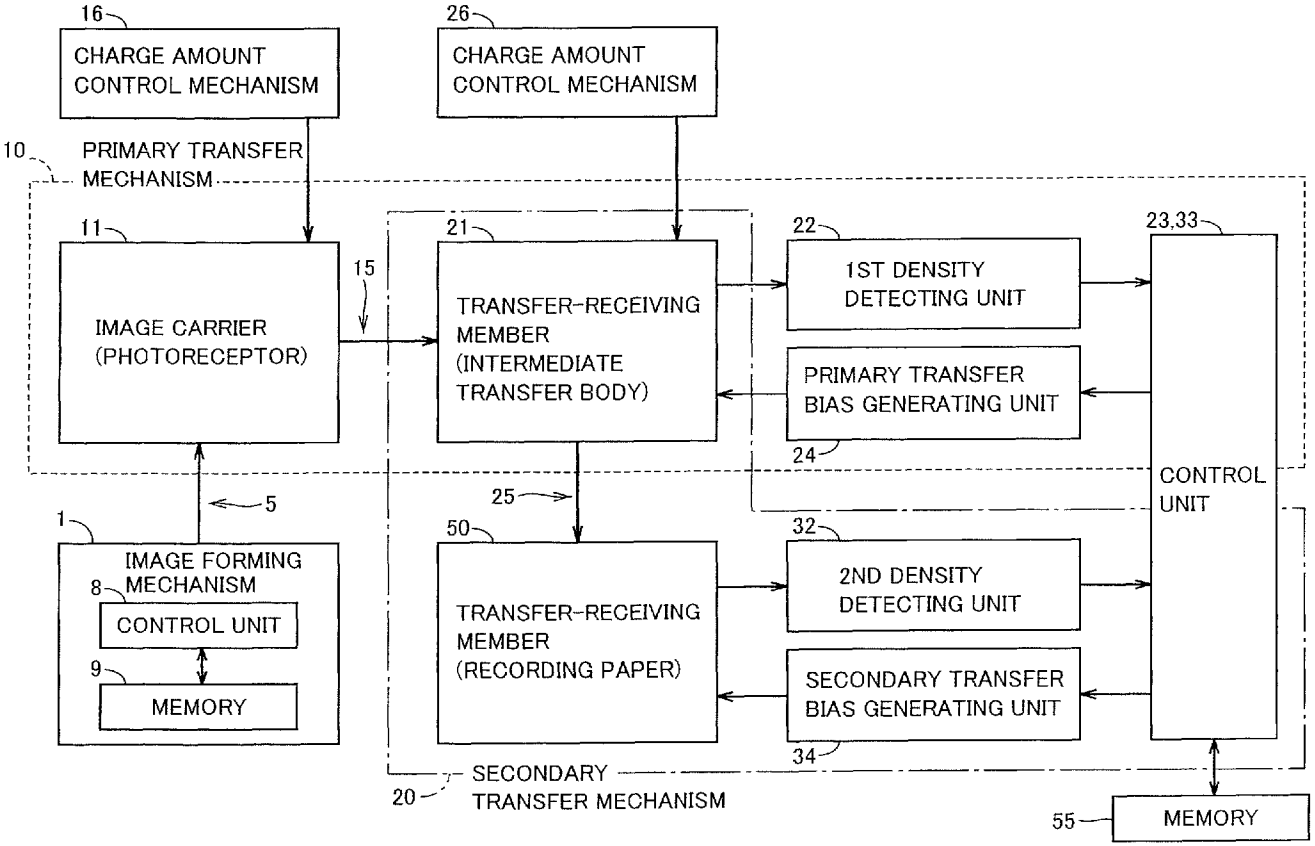
FIG. 6 is a block diagram showing various components realizing the control flow related to the patch image formation in the wet-type image forming apparatus in accordance with a modification of Embodiment 1.

As shown in FIG. 6, a charge amount control mechanism 16 may be connected to photoreceptor 11. Charge amount control mechanism 16 increases the amount of charges of the toner before the toner image is transferred (primary transfer) from photoreceptor 11 to intermediate transfer body 21. As the amount of charges of toner is increased, adherence between the toner before primary transfer and photoreceptor 11 increases, and the movement of toner preceding the transfer nip can be reduced. Since generation of image noise is reduced, it becomes possible to form images of still higher quality on a sheet of recording paper.

As shown in FIG. 6, a charge amount control mechanism 26 may be connected to intermediate transfer body 21. Charge amount control mechanism 26 increases the amount of charges of the toner before the toner image is transferred (secondary transfer) from intermediate transfer body 21 to the sheet of recording paper 50. As the amount of charges of toner is increased, adherence between the toner before secondary transfer and intermediate transfer body 21 increases, and the movement of toner preceding the transfer nip can be reduced. Since generation of image noise is reduced, it becomes possible to form images of still higher quality on a sheet of recording paper.

Embodiment 2

Wet-type Image Forming Apparatus 200

Figure 7:
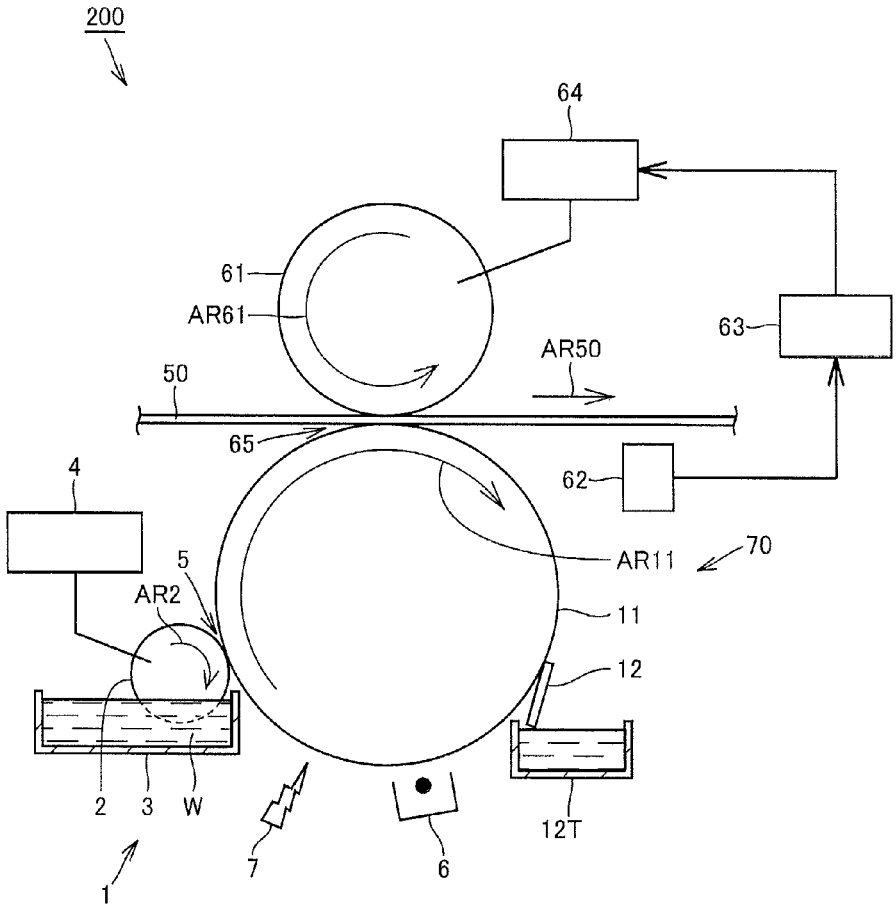
FIG. 7 is a schematic diagram showing a wet-type image forming apparatus in accordance with Embodiment 2.
Figure 8:
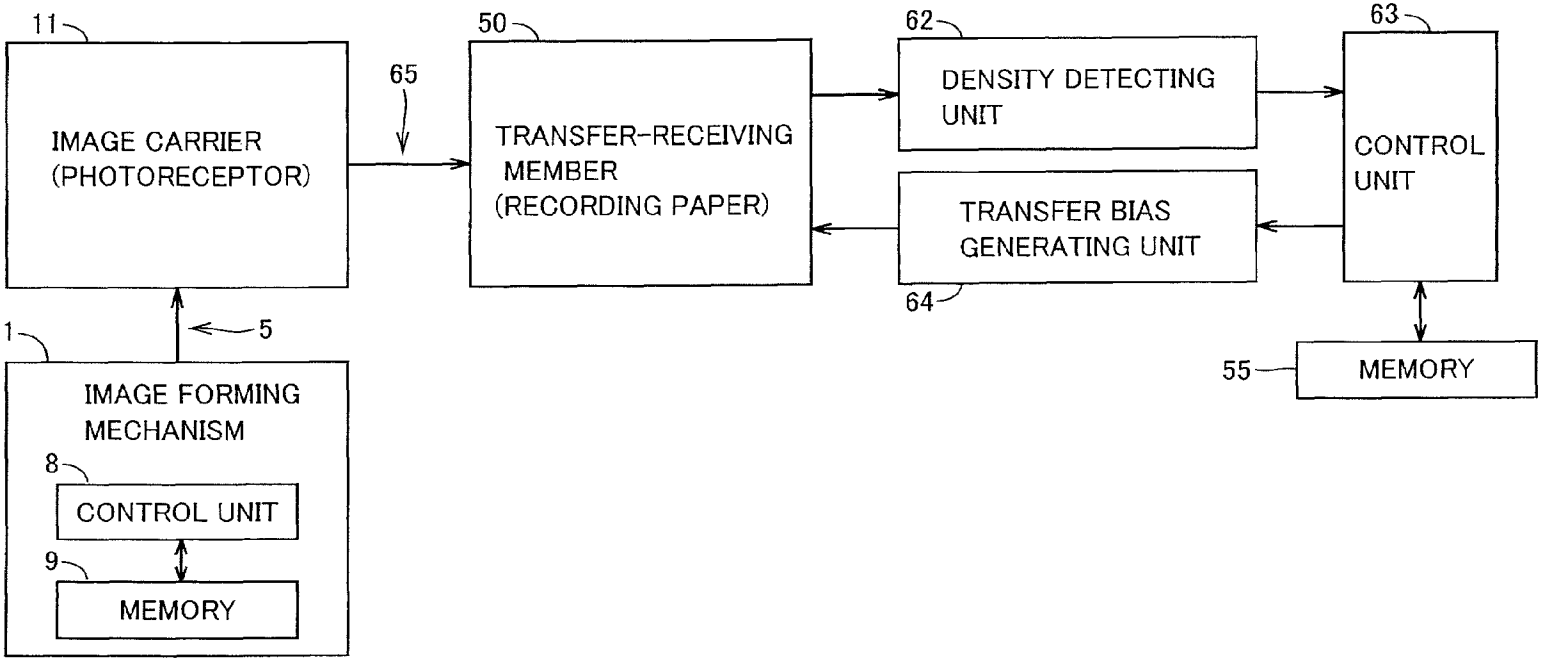
FIG. 8 is a block diagram showing various components realizing the control flow related to formation of patch images in the wet-type image forming apparatus in accordance with Embodiment 2.
Figure 9:
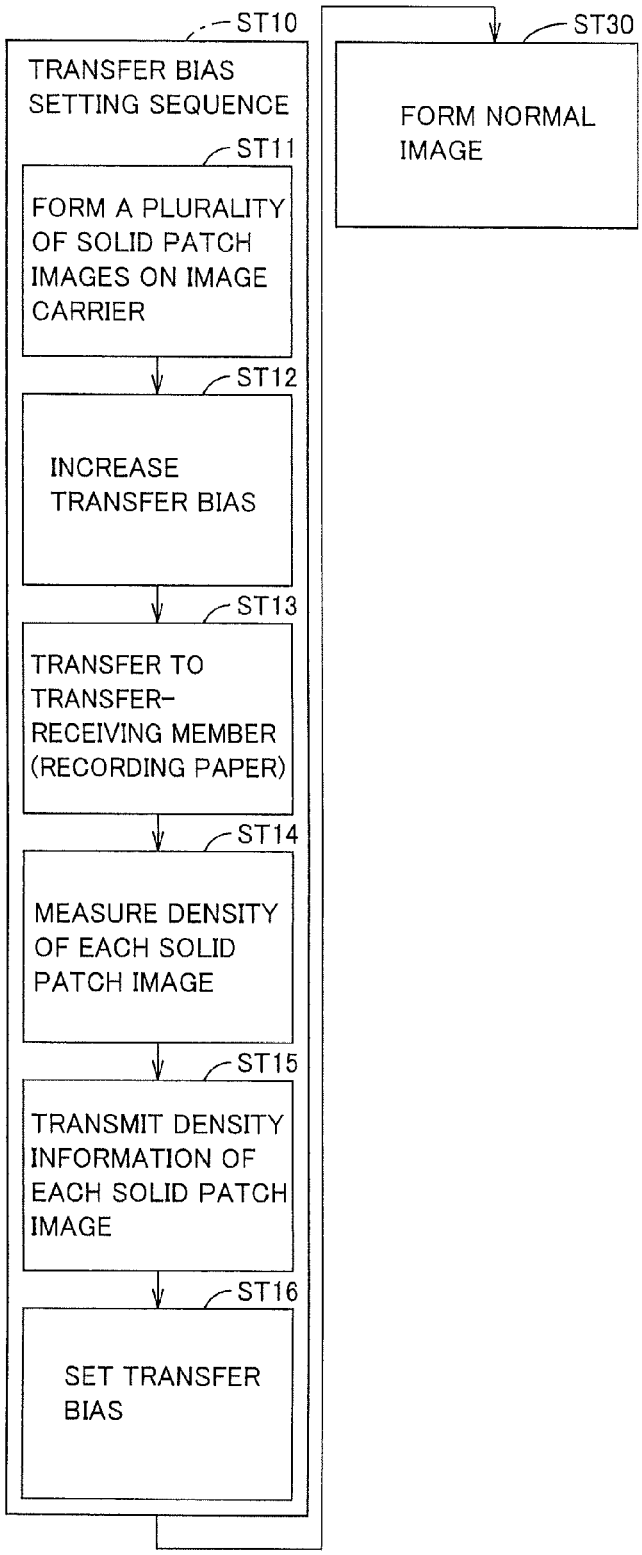
FIG. 9 shows a control flow related to formation of patch images and formation of a normal image of the wet-type image forming apparatus in accordance with Embodiment 2.

Referring to FIGS. 7 to 9, a wet-type image forming apparatus 200 in accordance with the present embodiment will be described. FIG. 7 schematically shows an overall configuration of wet-type image forming apparatus 200. FIG. 8 is a block diagram showing various components realizing the control flow related to formation of patch images in wet-type image forming apparatus 200. FIG. 9 shows a control flow related to formation of patch images and formation of a normal image of wet-type image forming apparatus 200.

As shown in FIG. 7, wet-type image forming apparatus 200 forms a prescribed image on a sheet of recording paper 50. The sheet of recording paper 50 is fed by photoreceptor 11 and a transfer roller 61 along a feeding direction AR 50. In the present embodiment, the sheet of recording paper 50 passes through a transfer portion 65 (details of which will be described later), not wound around transfer roller 61. The prescribed image includes a normal image formed based on an external signal input by a user of wet-type image forming apparatus 200 and patch images formed as a trial by wet-type image forming apparatus 200 for preventing occurrence of granular irregularity during formation of a normal image.

Wet-type image forming apparatus 200 in accordance with the present embodiment includes an image forming mechanism 1 and a transfer mechanism 70.

(Image Forming Mechanism 1)

Image forming mechanism 1 includes a developing roller 2 (developer carrier), a liquid developer W, a developer tank 3, a developing bias generator 4 (image forming unit), a charger 6 and an exposing device 7. Image forming mechanism visualizes an electrostatic latent image formed on a surface of a photoreceptor 11 using liquid developer W at a developing portion 5. By the visualization, a toner image (not shown) is formed on the surface of photoreceptor 11.

Liquid developer W is kept in developer tank 3. Liquid developer W contains toner particles and a carrier liquid. The toner particles are dispersed in the carrier liquid at a prescribed ratio. Developing roller 2 rotates in a direction of an arrow AR2, partially dipped in liquid developer W. Liquid developer W is drawn up to the surface of developing roller 2 as developing roller 2 rotates. Liquid developer W is carried on the surface of developing roller 2 and fed to developing portion 5 as developing roller 2 rotates.

Liquid developer W carried on developing roller 2 is adjusted such that liquid developer W has uniform thickness. The toner particles in liquid developer W with its thickness adjusted are, for example, charged "positive" by a developer charger (not shown). Developing bias generator 4 forms an electric field between developing roller 2 and photoreceptor 11, which will be described later, by applying a developing bias. Liquid developer W carried on developing roller 2 is transferred to the surface of photoreceptor 11 by the function of this electric field.

(Transfer Mechanism 70)

Transfer mechanism 70 includes a photoreceptor 11 (image carrier), a cleaning blade 12, a recovery tank 12T, transfer roller 61 (also referred to as a back-up roller), and a transfer bias generating unit 64. By way of example, a photoreceptor formed of positively chargeable amorphous silicon may be used as photoreceptor 11.

Photoreceptor 11 is arranged opposite to developing roller 2 of image forming mechanism 1, and opposite to transfer roller 61. Between photoreceptor 11 and developing roller 2, a developing portion 5 is formed. Between photoreceptor 11 and transfer roller 61, a transfer portion 65 is formed.

Photoreceptor 11 rotates in a direction of an arrow AR11. Developing roller 2 (developing portion 5), transfer roller 61 (transfer portion 65), cleaning blade 12, charger 6 and exposing device 7 are arranged around photoreceptor 11 in order, along the direction of rotation of photoreceptor 11.

Photoreceptor 11 has its surface uniformly charged to a prescribed potential by charger 6 of image forming mechanism 1. Photoreceptor 11 having its surface uniformly charged is exposed by exposing device 7 of image forming mechanism 1. An electrostatic latent image (not shown) based on prescribed image information is formed on the surface of photoreceptor 11. Photoreceptor 11 carries the electrostatic latent image thereon and conveys the electrostatic latent image to developing portion 5.

As will be described in detail later, exposing device 7 of image forming mechanism 1 in accordance with the present embodiment has the amount, scope and timing of exposure controlled based on common image information and additionally controlled by a control unit 8 (see FIG. 8). Control unit 8 is connected to a memory 9. Memory 9 stores information necessary for forming patch images, such as the amount, scope, and timing of exposure. As the exposing device 7 is controlled by control unit 8, electrostatic latent images corresponding to patch images (details of which will be described later) are formed on the surface of photoreceptor 11.

When the latent electrostatic image is conveyed to developing portion 5, toner particles in liquid developer W carried on developing roller 2 are moved by static electricity from the surface of developing roller 2 to the surface of photoreceptor 11 by the function of electric field generated by developing bias generator 4. At this time, not only toner particles but also carrier liquid adheres on the surface of photoreceptor 11. The latent electrostatic image that has been formed on the surface of photoreceptor 11 is visualized as a toner image (or patch images, as will be described later).

Photoreceptor 11 carries the toner image formed on its surface and conveys the toner image to transfer portion 65. Liquid developer W not transferred from developing roller 2 to photoreceptor 11 but remaining on developing roller 2 is scraped away from the surface of developing roller 2 by the cleaning blade (not shown) and then recovered.

As described above, transfer roller 61 is arranged opposite to photoreceptor 11. Transfer roller 61 rotates in a direction of an arrow AR61. Between photoreceptor 11 and transfer roller 61, transfer portion 65 is formed. Transfer bias generating unit 64 forms an electric field between photoreceptor 11 transfer roller 61 (recording surface of sheet of recording paper 50) by applying a transfer bias.

The toner image carried on photoreceptor 11 and conveyed to transfer portion 65 is transferred from the surface of photoreceptor 11 to the recording surface of the sheet of recording paper 50 by the function of electric field formed by transfer bias generating unit 64. The toner not subjected to the transfer but left on the surface of photoreceptor 11 as well as dirt and dust on the surface of photoreceptor 11 are scraped away from the surface of photoreceptor 11 by cleaning blade 12, and recovered in recovery tank 12T. Charges left on the surface of photoreceptor 11 are erased by an eraser lamp (not shown) or the like.

After the toner image is transferred, the sheet of recording paper 50 is fed to a fixing device (not shown). The toner particles in the toner image transferred to the sheet of recording paper 50 are heated and pressed by the fixing device. The toner image transferred to the sheet of recording paper is fixed on the surface of the sheet of recording paper 50 by this pressing and heating. Thereafter, the sheet of recording paper 50 is discharged to the outside through a paper discharge mechanism (not shown). As described above, a normal image forming operation of wet-type image forming apparatus 200 is completed.

(Transfer Bias Setting Sequence)

In wet-type image forming apparatus 200, when a normal image is formed on the sheet of recording paper 50, in order to prevent generation of granular irregularity or lower image density resulting therefrom, the transfer bias applied by the transfer bias generating unit 64 is set to a prescribed value, before forming a normal image.

As shown in FIG. 9, in wet-type image forming apparatus 200, a transfer bias setting sequence ST70 is executed, before forming the normal image (ST30). In the following, the transfer bias setting sequence ST70 will be described.

(Transfer Bias Setting Sequence ST70)

Transfer bias setting sequence ST70 is executed, for example, immediately after power-on of wet-type image forming apparatus 200, after a prescribed number of images are formed by wet-type image forming apparatus 200, and/or after a prescribed time passed from the last formation of an image by wet-type image forming apparatus 200.

The timing when transfer bias setting sequence ST70 is executed is stored, for example, in a memory 9 of image forming mechanism 1. Control unit 8 determines whether or not prescribed conditions are satisfied. Control unit 8 sends a signal to execute transfer bias setting sequence ST70 to a main control unit (not shown) of wet-type image forming apparatus 200.

Referring to FIGS. 7 to 9, when transfer bias setting sequence ST70 is executed, first, control unit 8 connected to exposing device 7 reads information related to the amount, scope and timing of exposure necessary for forming a plurality of patch images on photoreceptor 11, from memory 9. Exposing device 7 controlled by control unit 8 successively forms a plurality of electrostatic latent images corresponding to the plurality of solid patch images on photoreceptor 11.

The plurality of electrostatic latent images are conveyed to developing portion 5. By a developing bias (fixed value) applied by developing bias generating unit 4, the plurality of electrostatic images are visualized at developing portion 5. On the surface of photoreceptor 11, a plurality of solid patch images are formed at a portion upstream of transfer portion 15 (see sequence ST11 of FIG. 9).

The plurality of solid patch images move to transfer portion 65 as photoreceptor 11 rotates. When the solid patch images enter transfer portion 65, a transfer bias is applied by transfer bias generating unit 64 between photoreceptor 11 and transfer portion 65.

The bias value of transfer bias applied by transfer bias generating unit 64 is set lower by a prescribed value than the bias value used for general image formation, before the solid patch images enter the transfer portion 65. The bias value of transfer bias applied by transfer bias generating unit 64 is increased gradually by control unit 63 every time a solid patch image enters the transfer portion 65 (see sequence ST12 of FIG. 9).

The plurality of solid patch images are successively transferred, one by one in electrostatic manner, from photoreceptor 11 to the surface of the sheet of recording paper 50 at transfer portion 65, corresponding to each of a plurality of transfer biases attained by the change in bias value of the transfer bias (see sequence ST13 of FIG. 9).

As shown in FIG. 7, at a portion of recording surface of the sheet of recording paper 50 downstream of transfer portion 65, a density detecting unit 62 is arranged. The density detecting unit 62 detects density of each of the plurality of solid patch images transferred to the recording surface of the sheet of recording paper 50 based on reflected light of a laser beam (optical means) (see sequence ST14 of FIG. 9).

The image density information of each of the plurality of solid patch images detected by density detecting unit 62 is transmitted to control unit 63 (see sequence ST15 of FIG. 9).

As in sequence ST15 of primary transfer bias setting sequence ST10 of Embodiment 1 described above, as the bias value of transfer bias increases gradually, the image density of solid patch images transferred to the recording surface of the sheet of recording paper 50 also increases. Control unit 63 calculates the ranges R1 and R2 (see FIG. 5) of bias values of transfer bias when the image density of solid patch images is saturated, based on the information received from density detecting unit 62.

Here, "the image density of patch images is substantially saturated" means that the image density of patch image transferred to the recording surface of the sheet of recording paper 50 hardly changes even if the bias value of transfer bias increases. The situation where the image density of patch image is substantially saturated includes when the toner image or toner images conveyed to transfer portion 65 by the rotation of photoreceptor 11 are fully (100%) transferred to the recording surface of the sheet of recording paper 50. The situation where the image density of patch image is substantially saturated also includes when the toner images of a prescribed ratio (90% to 99%, depending on the accuracy of density detection) are transferred to the recording surface of the sheet of recording paper 50 with the image density hardly varying. The prescribed ratio is stored in advance in a memory 55 (see FIG. 8) connected to control unit 63.

By comparing the image density of each of the plurality of solid patch images received from the density detecting unit 62 with the prescribed ratio stored in memory 55, control unit 63 calculates the range R1 (the range in which the image density (transfer efficiency) is 90% to 100%, that is, the range where "B1≤bias value of transfer bias≤B3") of bias values of transfer bias when the image density of solid patch images is substantially saturated. Further, control unit 63 calculates another range R2 (the range in which the image density (transfer efficiency) is 90% to 100%, that is, the range where "B4≤bias value of transfer bias≤B6") of bias values of transfer bias when the image density of solid patch images is substantially saturated.

Thereafter, control unit 63 sets the bias value of transfer bias used for forming a normal image to a value within the ranges R1 and R2 and not larger than the absolute value of bias value at which the image density of patch image is saturated (that is, within the range R1) (see sequence ST16 of FIG. 9).

In transfer bias setting sequence ST70, the bias value of transfer bias used for forming a normal image is set at a prescribed value in the range R1, as a fixed value, through each of the sequences ST11 to ST16. For convenience of description, the range R1 of FIG. 5 is referred to for the description of both the primary transfer bias setting sequences ST10 of Embodiment 1 above and the transfer bias setting sequence ST70 of the present embodiment. The range R1 detected by the primary transfer bias setting sequence ST10 of the above-described Embodiment 1 is not always the same as the range R1 detected by the transfer bias setting sequence ST70 of the present embodiment.

In wet-type image forming apparatus 200, a normal image is formed (ST30) after the transfer bias setting sequence ST70 is executed, as described above.

(Functions/Effects)

As described with reference to Embodiment 1 above, the phenomenon referred to as "granular irregularity" in which portions having densely concentrated toner particles and portions having sparse toner particles appear periodically occurs when the transfer efficiency of toner image reaches substantially 100% and thereafter a higher transfer bias is applied.

The reason for this is as follows. When a high transfer bias is applied to the transfer portion, a strong electric field is formed also in a space positioned upstream of the transfer portion (nip portion), and the toner particles in the toner image before transfer undesirably move. In contrast, in wet-type image forming apparatus 200 in accordance with the present embodiment, the bias value smaller in absolute value than the value immediately before occurrence of granular irregularity is set as the transfer bias.

In wet-type image forming apparatus 200, occurrence of granular irregularity can be prevented and, in addition, high efficiency of transferring toner image can be attained at the time of forming a normal image. Therefore, by wet-type image forming apparatus 200, it is possible to form images of higher quality on a sheet of recording paper.

(Modification)

Wet-type image forming apparatuses 100 and 200 of the above-described embodiments each include one image forming mechanism, 1, one primary transfer mechanism 10 and one secondary transfer mechanism 20. Wet-type image forming apparatuses 100 and 200 may each have four image forming mechanisms 1, four primary transfer mechanisms and four secondary transfer mechanisms 20.

The number of image forming mechanism 1, primary transfer mechanism 10 and secondary transfer mechanism 20 is increased/decreased in accordance with the number of liquid developers. If wet-type image forming apparatuses 100 and 200 have four image forming mechanisms and four other mechanisms each, the image forming mechanisms 1, for example, correspond to Y (Yellow), M (Magenta), C (Cyan) and K (blacK), respectively.

The order of arranging yellow, magenta, cyan and black may be arbitrarily changed. In wet-type image forming apparatus 100, colors other than yellow, magenta, cyan and black may be used.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image forming apparatus forming an image on a transfer-receiving member, comprising:

an image carrier carrying an electrostatic latent image on its surface;

a developer carrier carrying on its surface a liquid developer having toner dispersed in a carrier liquid;

an image forming unit configured to visualize said electrostatic latent image by said toner in said liquid developer carried on said developer carrier and to form a toner image on said image carrier;

a transfer unit configured to transfer said toner image formed on said image carrier to said transfer-receiving member by applying a transfer bias; and a density detecting unit configured to detect image density of said toner image as a patch image transferred to said transfer-receiving member; wherein a plurality of said patch images are successively formed on said image carrier before being successively transferred to said transfer-receiving member;

said plurality of patch images are successively transferred to said transfer-receiving member by the transfer unit, each of the plurality of patch images being transferred by the transfer unit at different transfer bias values;

said density detecting unit measures said image density of each of said plurality of patch images successively transferred to said transfer-receiving member by the transfer unit at different transfer bias values, and detects a range of transfer bias values in which said image density of said patch image is substantially saturated; and the transfer bias value when said image is formed on said transfer-receiving member is set to be within the range of transfer bias values in which said image density of said patch image is substantially saturated and to be not larger than absolute value of the transfer bias value at which said image density of said patch image is substantially saturated.

2. The wet-type image forming apparatus according to claim 1, wherein said density detecting unit detects said image density of said toner image transferred to said transfer-receiving member by optical means.

3. The wet-type image forming apparatus according to claim 1, wherein the transfer bias value when said image is formed on said transfer-receiving member is set to be a range of transfer bias values corresponding to said image density of said patch image being at least 90% and at most 100% of said image density when saturated, and to be not larger than absolute value of the transfer bias value at which said image density of said patch image is saturated.

4. The wet-type image forming apparatus according to claim 1, wherein said transfer unit transfers the toner image formed on said image carrier by means of an intermediate transfer body.

5. A method of setting a transfer bias in a wet-type image forming apparatus forming an image on a transfer-receiving member, wherein said wet-type image forming apparatus includes an image carrier carrying an electrostatic latent image on its surface, a developer carrier carrying on its surface a liquid developer having toner dispersed in a carrier liquid, an image forming unit configured to visualize said electrostatic latent image by said toner in said liquid developer carried on said developer carrier and to form a toner image on said image carrier, a transfer unit configured to transfer said toner image formed on said image carrier to said transfer-receiving member by applying a transfer bias, and a density detecting unit configured to detect image density of said toner image as a patch image transferred to said transfer-receiving member;

said method comprising the steps of:

successively forming a plurality of said patch images on said image carrier before successively transferring said plurality of patch images to said transfer-receiving member;

successively transferring said plurality of patch images to said transfer-receiving member, each of the plurality of patch images being transferred by the transfer unit at different transfer bias values;

said density detecting unit measuring said image density of each of said plurality of patch images successively transferred to said transfer-receiving member at different transfer bias values;

determining a range of transfer bias values in which said image density of said patch image is substantially saturated; and setting the transfer bias value when said image is formed on said transfer-receiving member to be within the range of transfer bias values in which said image density of said patch image is substantially saturated and to be not larger than absolute value of the transfer bias value at which said image density of said patch image is substantially saturated.

6. The method of setting a transfer bias in a wet-type image forming apparatus according to claim 5, wherein said density detecting unit detects said image density of said toner image transferred to said transfer-receiving member by optical means.

7. The method of setting a transfer bias in a wet-type image forming apparatus according to claim 5, wherein the transfer bias value when said image is formed on said transfer-receiving member is set to be a range of transfer bias values corresponding to said image density of said patch image being at least 90% and at most 100% of said image density when saturated, and to be not larger than absolute value of the transfer bias value at which said image density of said patch image is saturated.

8. The method of setting a transfer bias in a wet-type image forming apparatus according to claim 5, wherein said transfer unit transfers the toner image formed on said image carrier by means of an intermediate transfer body.

* * * * *